US012186647B2

(12) United States Patent
Craig et al.

(10) Patent No.: US 12,186,647 B2
(45) Date of Patent: Jan. 7, 2025

(54) FACE GUARD

(71) Applicant: Under Armour, Inc., Baltimore, MD (US)

(72) Inventors: Seden Craig, Baltimore, MD (US); Derek Campbell, Baltimore, MD (US); Kyle Blakely, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 397 days.

(21) Appl. No.: 17/410,986

(22) Filed: Aug. 24, 2021

(65) Prior Publication Data

US 2022/0054929 A1 Feb. 24, 2022

Related U.S. Application Data

(60) Provisional application No. 63/069,597, filed on Aug. 24, 2020.

(51) Int. Cl.
*A63B 71/08* (2006.01)
*A41D 13/11* (2006.01)

(52) U.S. Cl.
CPC ..... *A63B 71/085* (2013.01); *A41D 13/1161* (2013.01)

(58) Field of Classification Search
CPC ..... A63B 71/08; A63B 71/085; A63B 71/10; A63B 2102/24; A63B 2243/007; A63B 2071/08; A63B 2071/085; A63B 2071/086; A63B 2071/088; A63B 33/00; A41D 13/00; A41D 13/05; A41D 13/11; A41D 13/1161; A41D 13/1192; A41D 13/1138; A41D 13/1115; A61M 16/0488; A61M 16/049; A61M 16/0493; A61M 16/06; A61M 16/0605; A61M 16/0661; A61M 16/0683; A61M 16/0688; A61M 16/0616; A62B 9/06; A62B 18/086; A62B 18/025;
(Continued)

(56) References Cited

U.S. PATENT DOCUMENTS 1,265,129 A * 5/1918 Spotswood ..... A41D 13/11 2/206
3,082,765 A 3/1963 Helmer
(Continued)

FOREIGN PATENT DOCUMENTS

WO 2018124504 A1 7/2018
WO 2019022020 A1 1/2019
(Continued)

OTHER PUBLICATIONS

Spacer Fabric, Feb. 2, 2020 [online], [retrieved on Nov. 3, 2023]. Retrieved from the Internet <URLhttps://www.monofabrics.com/msg/msg10.html (Year: 2020).*

*Primary Examiner* — Ophelia A Hawthorne
*Assistant Examiner* — Gina McCarthy
(74) *Attorney, Agent, or Firm* — Maginot, Moore & Beck, LLP

(57) ABSTRACT

A face guard is disclosed herein. The face guard is configured for a human user having a face with a mouth and nose. The face guard includes a mouthpiece configured for retention in the mouth of the human user. The face guard also includes a face mask coupled to the mouthpiece, wherein the face mask configured to cover the mouth and nose of the human user.

17 Claims, 7 Drawing Sheets

(58) Field of Classification Search
CPC ..... A62B 23/025; A61C 5/90; A61C 7/36; A61F 5/56; A61F 5/566; A61F 13/08
See application file for complete search history.

(56) References Cited

U.S. PATENT DOCUMENTS

| | | | | |
|---|---|---|---|---|
| 3,203,417 | A | 8/1965 | Helmer | |
| 4,195,629 | A | 4/1980 | Halford | |
| 4,719,911 | A * | 1/1988 | Carrico | A62B 9/06 128/206.29 |
| 4,790,307 | A | 12/1988 | Haber | |
| 5,537,994 | A * | 7/1996 | Thornton | A61F 5/566 128/207.18 |
| 5,701,892 | A | 12/1997 | Bledstein | |
| 6,336,459 | B1 | 1/2002 | Miyake et al. | |
| 6,644,314 | B1 | 11/2003 | Elsberg | |
| D567,365 | S | 4/2008 | Brunell | |
| D567,937 | S | 4/2008 | Gerson et al. | |
| 7,677,248 | B2 | 3/2010 | Gerson et al. | |
| D620,104 | S | 7/2010 | Curran et al. | |
| D638,171 | S | 5/2011 | Goranov et al. | |
| D646,380 | S | 10/2011 | Gebrewold et al. | |
| 8,061,356 | B2 | 11/2011 | Bowen | |
| D657,050 | S | 4/2012 | Henderson et al. | |
| 8,171,933 | B2 | 5/2012 | Xue et al. | |
| 8,251,065 | B2 | 8/2012 | Kim | |
| 8,496,009 | B2 | 7/2013 | Manzo | |
| 8,528,560 | B2 | 9/2013 | Duffy | |
| 8,640,704 | B2 | 2/2014 | Spoo et al. | |
| 8,695,603 | B2 | 4/2014 | Harold et al. | |
| D704,824 | S | 5/2014 | Duffy et al. | |
| D708,734 | S | 7/2014 | Curran et al. | |
| 8,881,729 | B2 | 11/2014 | Duffy | |
| 8,905,034 | B2 | 12/2014 | Goranov et al. | |
| 8,931,488 | B2 | 1/2015 | Evans et al. | |
| 9,333,413 | B2 | 5/2016 | Evans et al. | |
| 9,386,813 | B2 | 7/2016 | Nagao et al. | |
| 9,408,424 | B2 | 8/2016 | Noh et al. | |
| D776,257 | S | 1/2017 | Remer et al. | |
| 9,603,395 | B2 | 3/2017 | Duffy | |
| 9,603,396 | B2 | 3/2017 | Duffy | |
| 9,615,612 | B2 | 4/2017 | Duffy | |
| 9,616,258 | B2 | 4/2017 | Tsuei | |
| 9,630,082 | B2 | 4/2017 | Zents | |
| 9,655,392 | B2 | 5/2017 | Mekler et al. | |
| 9,687,722 | B2 | 7/2017 | Kennedy | |
| 9,717,975 | B2 | 8/2017 | Evans et al. | |
| 9,770,057 | B2 | 9/2017 | Duffy | |
| 9,770,058 | B2 | 9/2017 | Angadjivand et al. | |
| 9,770,611 | B2 | 9/2017 | Facer et al. | |
| 9,826,786 | B2 | 11/2017 | Duffy | |
| 9,868,002 | B2 | 1/2018 | Duffy | |
| 9,963,611 | B2 | 5/2018 | Stewart et al. | |
| D822,195 | S | 7/2018 | Kwong et al. | |
| 10,136,687 | B2 | 11/2018 | Duffy | |
| 10,143,246 | B2 | 12/2018 | Houde et al. | |
| D837,970 | S | 1/2019 | Henderson et al. | |
| 10,182,603 | B2 | 1/2019 | Duffy | |
| 10,201,198 | B2 | 2/2019 | Tong et al. | |
| 10,227,202 | B2 | 3/2019 | Pamperin | |
| 10,238,158 | B2 | 3/2019 | Duffy | |
| 10,492,547 | B2 | 12/2019 | Weber et al. | |
| 10,494,221 | B2 | 12/2019 | Harris et al. | |
| 10,575,571 | B2 | 3/2020 | Angadjivand et al. | |
| 10,576,314 | B2 | 3/2020 | Duffy | |
| 10,602,785 | B2 | 3/2020 | Duffy | |
| D885,583 | S | 5/2020 | Haiola et al. | |
| 2001/0015205 | A1 | 8/2001 | Bostock | |
| 2002/0139375 | A1 * | 10/2002 | Kulick | A61F 5/566 128/848 |
| 2005/0139217 | A1 | 6/2005 | Chiam | |
| 2006/0085881 | A1 * | 4/2006 | Gellis | A41D 13/11 2/9 |
| 2007/0267022 | A1 | 11/2007 | Chiam | |
| 2007/0283964 | A1 * | 12/2007 | Gorman | A62B 23/025 128/206.29 |
| 2008/0006274 | A1 * | 1/2008 | Thornton | A61M 16/0493 264/222 |
| 2010/0056973 | A1 * | 3/2010 | Farrow | A61F 13/08 607/152 |
| 2010/0154805 | A1 | 6/2010 | Duffy et al. | |
| 2010/0330140 | A1 * | 12/2010 | Stewart | A61P 11/00 424/641 |
| 2012/0111344 | A1 * | 5/2012 | Goranov | A41D 13/1115 29/428 |
| 2012/0180800 | A1 | 7/2012 | Shibata | |
| 2013/0047995 | A1 | 2/2013 | Shibata | |
| 2013/0186414 | A1 | 7/2013 | Suzuki | |
| 2014/0034059 | A1 | 2/2014 | Yagi | |
| 2014/0182593 | A1 | 7/2014 | Duffy | |
| 2014/0209098 | A1 | 7/2014 | Dunn | |
| 2015/0209645 | A1 | 7/2015 | Zents | |
| 2015/0238783 | A1 | 8/2015 | Nguyen et al. | |
| 2015/0306432 | A1 | 10/2015 | Orofino | |
| 2017/0014653 | A1 | 1/2017 | Duffy | |
| 2017/0113099 | A1 * | 4/2017 | Campbell | A63B 71/085 |
| 2017/0157436 | A1 | 8/2017 | Hosmer | |
| 2017/0258150 | A1 | 9/2017 | Abdulqader et al. | |
| 2017/0274228 | A1 | 9/2017 | Nguyen et al. | |
| 2017/0281889 | A1 * | 10/2017 | Voncken | A61M 16/0616 |
| 2017/0303608 | A1 | 10/2017 | Chen et al. | |
| 2017/0368384 | A1 | 12/2017 | Facer et al. | |
| 2018/0021608 | A1 | 1/2018 | Zhou et al. | |
| 2018/0027899 | A1 | 2/2018 | Facer et al. | |
| 2018/0146733 | A1 | 5/2018 | Greenblat | |
| 2018/0154195 | A1 | 6/2018 | Henderson et al. | |
| 2018/0169447 | A1 | 6/2018 | Eitzman et al. | |
| 2018/0295906 | A1 | 10/2018 | Harris et al. | |
| 2018/0311905 | A1 | 11/2018 | Harrington et al. | |
| 2018/0368493 | A1 | 12/2018 | Houde | |
| 2018/0368494 | A1 | 12/2018 | Henderson | |
| 2019/0000162 | A1 | 1/2019 | Houde | |
| 2019/0069611 | A1 | 3/2019 | Potnis | |
| 2019/0126585 | A1 | 5/2019 | Potnis | |
| 2019/0209911 | A1 | 7/2019 | Turkbas | |
| 2020/0047056 | A1 | 2/2020 | Wilson | |
| 2020/0113256 | A1 | 4/2020 | Wagner | |
| 2021/0093900 | A1 * | 4/2021 | Edwards | A61M 16/049 |
| 2021/0106976 | A1 | 4/2021 | Bohringer | |
| 2021/0353979 | A1 * | 11/2021 | Lean | A62B 18/086 |
| 2021/0386134 | A1 * | 12/2021 | Plank | A41D 13/1192 |
| 2022/0047896 | A1 * | 2/2022 | Salvino | A41D 13/1138 |
| 2022/0134138 | A1 * | 5/2022 | Cheng | A62B 18/025 128/863 |
| 2022/0338569 | A1 * | 10/2022 | Myung | A61M 16/0688 |

FOREIGN PATENT DOCUMENTS

| | | | |
|---|---|---|---|
| WO | 201903241 | A1 | 2/2019 |
| WO | 2019135150 | A1 | 7/2019 |

* cited by examiner

FACE GUARD

CROSS-REFERENCE TO RELATED APPLICATIONS

This application claims the benefit of U.S. Provisional Patent Application Ser. No. 63/069,597, filed Aug. 24, 2021, the entire contents of which are incorporated by reference herein.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD

This application relates to the field of mouth guards used by athletes when participating in sporting events.

BACKGROUND

Mouth guards are widely used by athletes when participating in sporting events, and especially contact sports such as football or hockey. Conventional mouth guards are inserted into the mouth during athletic activity, and periodically removed during breaks or other times of rest. While these mouth guards are typically effective at providing some level of protection for the mouth and teeth of the wearer, they are sometimes difficult to use in association with other pieces of equipment such as helmets or other headgear.

Face masks are commonly used by medical professionals in hospitals and other medical facilities in order to limit the transmission of disease. During seasons of epidemic or pandemic, face masks may also be required in association with other activities that require human interactions, such as sporting events. For athletes that wear mouth guards, face-masks provide an additional challenge. For example, access to the mouth guard is difficult when wearing a face mask, making periodic removal of the mouth guard inconvenient. Moreover, both the face mask and the mouth guard can interfere with typical breathing, making simultaneous use of both a face mask and a mouth guard very uncomfortable for the athlete.

In view of the foregoing, it would be advantageous to provide an arrangement that allows an athlete to make simultaneous use of both a face mask and a mouth guard. It would be advantageous if such arrangement were both comfortable for the wearer while also providing effective mouth protection. Moreover, it would be advantageous for the arrangement to be highly breathable apparatus while also offering effective filtering of pathogens.

SUMMARY

A face guard is configured for a human user having a face with a mouth and nose. The face guard includes a mouthpiece configured for retention in the mouth of the human user. The face guard also includes a face mask coupled to the mouthpiece, wherein the face mask configured to cover the mouth and nose of the human user.

BRIEF DESCRIPTION OF THE DRAWINGS

The foregoing aspects and other features of a face guard are explained in the following description, taken in connection with the accompanying drawings.

All Figures © Under Armour, Inc. 2020. All rights reserved.

DESCRIPTION

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

Face Guard with Mouthpiece and Integrated Face Mask

Figure 1:
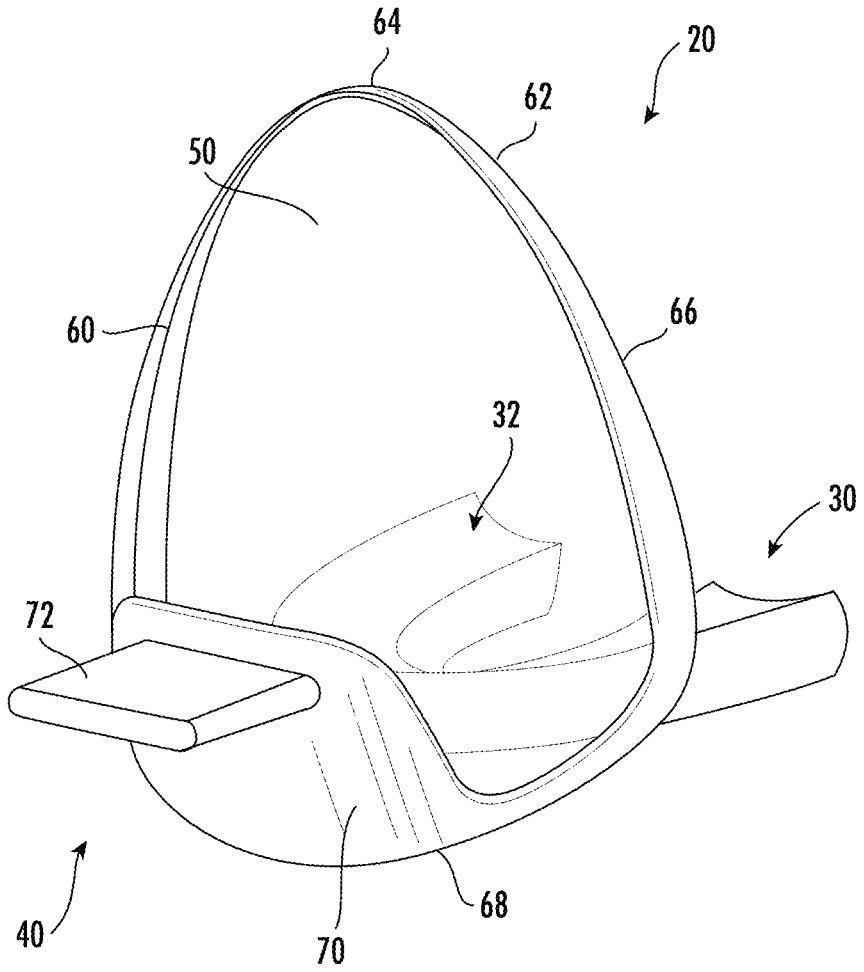
FIG. 1 is a front perspective view of a face guard with a mouthpiece and integrated face mask with a shield body of the face mask shown in transparency.
Figure 2:
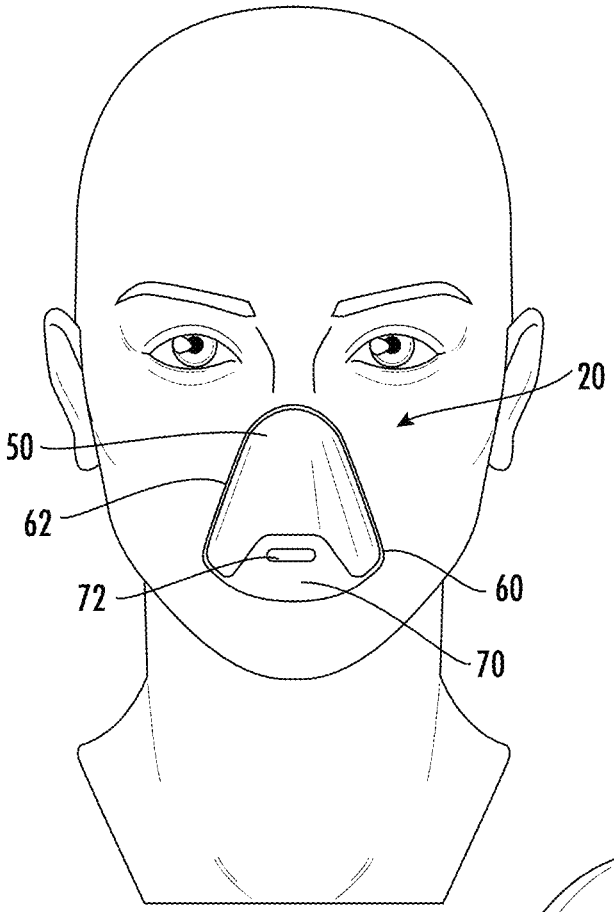
FIG. 2 is a front view of the face guard of FIG. 1 positioned on an athlete.
Figure 3:
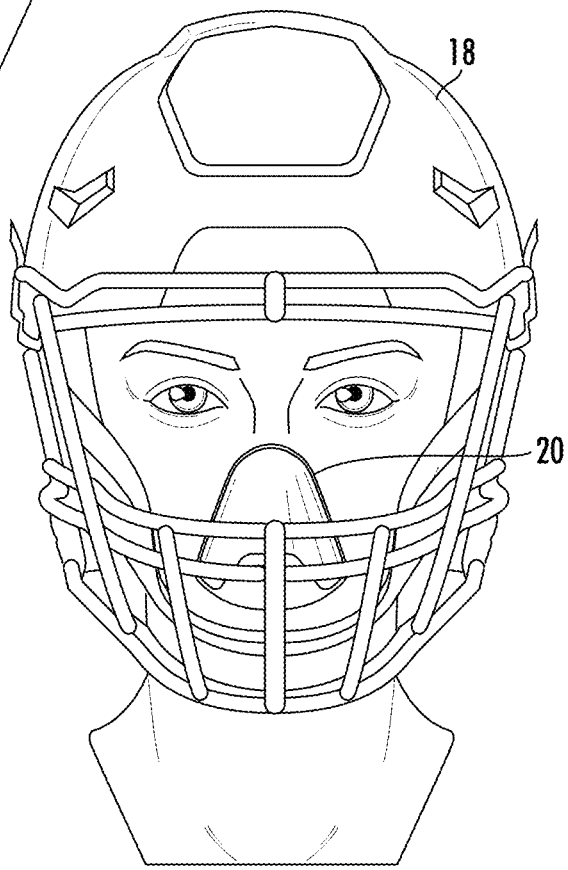
FIG. 3 is a front view of the athlete of FIG. 2 wearing both the face guard and a helmet.

With reference to FIGS. 1-3, a face guard 20 is shown. The face guard 20 (which may also be referred to herein as a "sports guard") includes a mouthpiece 30 and an integrated face mask 40. Because the face mask 40 is coupled to the mouthpiece as a unitary device, the face mask 40 is conveniently worn any time the mouthpiece 30 is used. The mouthpiece 30 provides protection for the mouth of the athlete, and the face mask 40 is comprised of a material that reduces the spread of droplets from the nose and mouth of the athlete.

Figure 11:
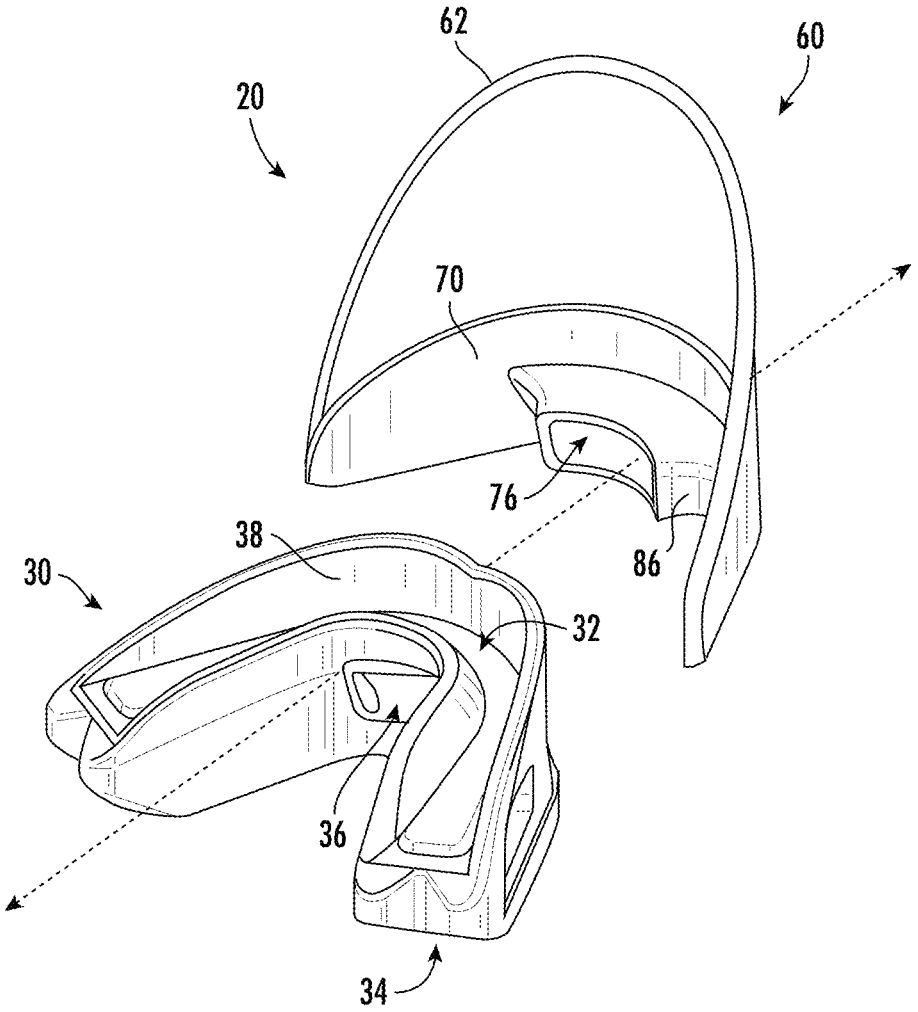
FIG. 11 is a perspective view of an exemplary mouthpiece and face mask combination for use with one of the embodiments of the face guard as shown in FIGS. 1-10.

The mouthpiece 30 may be provided in any of various forms. For example, the mouthpiece 30 may be a single arch mouthpiece that includes a single tooth-receiving channel designed to receive either the upper or lower teeth of the human mouth. Alternatively, the mouthpiece 30 may be a dual arch mouthpiece that includes both upper and lower tooth-receiving channels. Therefore, although a single arch mouthpiece is illustrated in FIG. 1, it will be recognized that the mouthpiece may take any of various forms. For example, as shown in FIG. 11, the mouthpiece 30 may be a dual arch mouthpiece that includes an upper tooth-receiving channel 32 and a lower tooth-receiving channel 34. A front wall 38 is formed along the front of each channel. The front wall is configured to fit between the user's gum and lips, with the lips positioned on the outside of the front wall. An air passage 36 may be formed in the mouthpiece 30 between the upper and lower channels 32 and 34 to facilitate breathing by the user. The air passages 36 extend completely through the front of the mouthpiece 30, thus allowing air to enter into and be expelled from the mouth of the user. An example of such a mouthpiece is described in further detail in U.S. Pat. No. 8,496,009, issued Jul. 30, 2013, to Manzo, the entire contents of which are incorporated herein by reference.

The mouthpiece 30 is generally formed from conventional thermoplastic materials commonly used for sporting mouthpieces. For example, the mouthpiece may be formed from conventional "boil and bite" thermoplastic material. As is known in the art, this material softens when heated to a threshold temperature that is greater than body temperature (e.g., a temperature of about 110° to 120°), and then, when cooled as it is fit in the user's mouth, hardens to a more rigid form that is left with an impression of the user's teeth and a custom-fit dental appliance.

With reference again to FIG. 1, the face mask 40 (which may also be referred to herein as a "face shield") is coupled to the mouthpiece 30. The coupling between the mouthpiece 30 and the face mask 40 may be permanent, such that the mouthpiece 30 and face mask 40 are monolithic, and the face mask 40 may not be removed from the mouthpiece 30 without destruction thereof. For example, a post, bracket, wall or other mounting member may extend between the front of the mouth piece 30 and a rear surface of the frame 60. Alternatively, in at least one embodiment, the coupling between the face mask 40 and the mouthpiece 30 is releasable such that the face mask 40 can be repeatedly released from and subsequently re-connected to the mouthpiece 30. An example of such an arrangement is shown and described below in association with FIG. 11.

With continued reference to FIGS. 1-3, the face mask 40 generally includes a frame 60 that retains a shield body 50. The frame 60 includes a rim 62 and a base portion 70. The rim 62 defines a perimeter of the face mask 40 and provides structural support for the shield body 50. The rim 62 includes an upper portion 64 that is designed and dimensioned to extend over the nose of the human wearer at a location between the bridge of the nose and the tip of the nose. The rim 62 also includes side portions 66 that extend downwardly and outwardly from the upper portion. The side portions 66 are designed and dimensioned to extend across a region of the wearer's face between the nose and the cheekbones. The rim 62 also includes a lower portion 68 that is designed and dimensioned to extend under the mouth of the wearer, between the lower lips and the chin.

The base portion 70 of the frame 60 is integrally formed with the lower portion 68 of the rim 62. In the embodiments disclosed herein, the base portion is a shield-like member that is designed and dimensioned to generally cover the lips mouth of the wearer. In the embodiment of FIG. 1, the base portion 70 is comprised of a continuous surface on the front of the face mask 40 that is about the size of human lips in a slightly open configuration. Thus, the base portion 70 may be generally oval shaped with a widest dimension extending from left to right across the front of the frame. In the embodiment of FIG. 1, a grab tab 72 extends outwardly from the base portion 70 of the frame 60. The grab tab 72 may be easily accessed and grasped by the user. While the surface of the base portion 70 is shown as being continuous and uninterrupted in the embodiment of FIG. 1, it will be recognized that the base portion may be differently configured in other embodiments. For example, in other embodiments, such as that of FIGS. 4-10, the base portion may include an air passageway, as described in further detail below.

The frame 60 is generally made of a material that provides support for the body 50, but is relatively soft and comfortable against the skin of the wearer. In at least one embodiment, the frame 60 is made of a thermoplastic material such as polyurethane. In at least one embodiment the frame 60 is made of the same material as the mouthpiece 30, such as the aforementioned "boil and bite" material. This allows the rim 62 to be easily adjusted to the contours of the face of the wearer at the same time the mouthpiece 30 is heated and custom fit to the user's mouth. This provides an effective fit for the face mask 40 against the wearer's face. However, in at least some embodiments, the frame 60 is comprised of a different thermoplastic material than the mouthpiece 30 such that the frame is not easily malleable at the same relatively low threshold temperature as that of the mouthpiece. In such embodiment, the frame 60 may include a flexible metal wire or other membrane that is encased within the thermoplastic material or other material, such as a soft fabric covering. The metal wire and thermoplastic material may be easily bent such that the rim 62 matches the contours of the face of the wearer. After the rim 62 is bent, the metal retains its shape, thus allowing the rim 62 to maintain engagement with the face of the wearer.

The shield body 50 is connected to and extends across the frame 60. The shield body is generally formed of at least one sheet of material with air filtration and air permeability qualities that render the material appropriate for a face mask. The sheet of material may be provided from a single piece of fabric or multiple pieces of fabric or other material. For example, the sheet of material may be provided by a tightly woven fabric made of cotton, polyester, other material, or a blend thereof. As explained in further detail below with reference to FIG. 7, in at least one embodiment, the shield body is comprised of a three-layer sheet of material including a foam layer positioned between two fabric layers. The multi-layer construction may be a molded textile formed into a desired shape that provides a generally convex contour to the body 50 (when viewed from the outside). The multi-layer construction may alternatively include stitching at various locations across the body in order to add additional structure to the body 50. In at least one embodiment, at least one layer of the body 50 is provided by a relatively soft and flexible stretch fabric material configured for comfort when placed against the skin of the wearer, such as Iso-Chill Heat Gear® fabric sold by Under Armour, Inc. As noted above, this soft and flexible stretch fabric material may extend to and encase the rim 62 to provide comfort to the face of the user when the mouth piece is in utilized. In particular, the fabric material may cover the interior portion of the rim 62 such that the fabric material is the portion of the mouth piece that abuts the skin of the user at the nose and cheeks during use.

The body 50 is connected to the frame 60 using any of various methods for connecting a fabric material to a thermoplastic. In at least one embodiment, the body 50 is connected to the frame 60 by stitching. In another embodiment, the body 50 is connected to the frame by heat welding or by use of adhesives. The perimeter edges of the body 50 may be arranged to fit exactly within the rim, or may be made to cover either the inner portion or the outer portion of the rim.

With particular reference now to FIG. 2, in order to don the face guard 20, the athlete simply places the mouthpiece 30 in their mouth with the teeth in the tooth-receiving channels of the mouthpiece 30. With the mouthpiece 30 properly positioned in the athlete's mouth, the face mask 40 is automatically positioned on the face of the athlete. In particular, the face mask 40 completely covers the orifices of the mouth and nose of the athlete, thus blocking or abating the discharge of fluids from the mouth and nose of the athlete during a competition or other sporting event. At the same time, the face mask 40 provides an effective barrier that reduces the number of pathogens that would otherwise be inhaled by the athlete during the sporting event.

As shown in FIG. 3, the size of the face guard 20 is such that it may be easily used in association with other athletic equipment, such as a football helmet 18. The face guard 20 fits on the athlete's face with a relatively low profile such that it does not interfere with the cage of the helmet 18 in any way. Furthermore, the chin strap of the helmet may easily extend across the chin of the athlete without contacting the face guard 20. Because the face guard 20 can be mounted on the face of the athlete without straps that extend to the ears or the back of the head, there is also no interference with the padding on the interior of the helmet. Moreover, the face guard 20 may be easily inserted into and removed from the face of the wearer without the need to remove the helmet 18.

Face Guard with Air Passage Included in Mouthpiece and Face Mask

Figure 4:
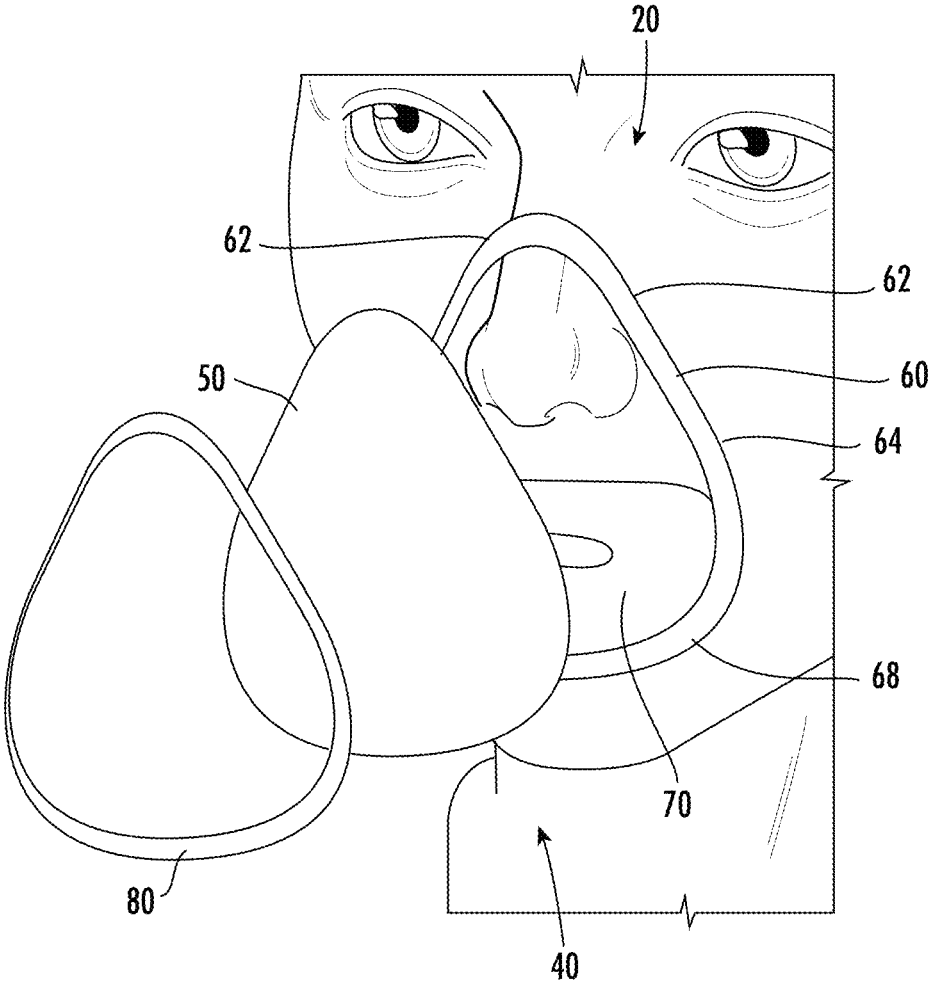
FIG. 4 is an exploded isometric view of an alternative embodiment of the face guard of FIG. 1.
Figure 5:
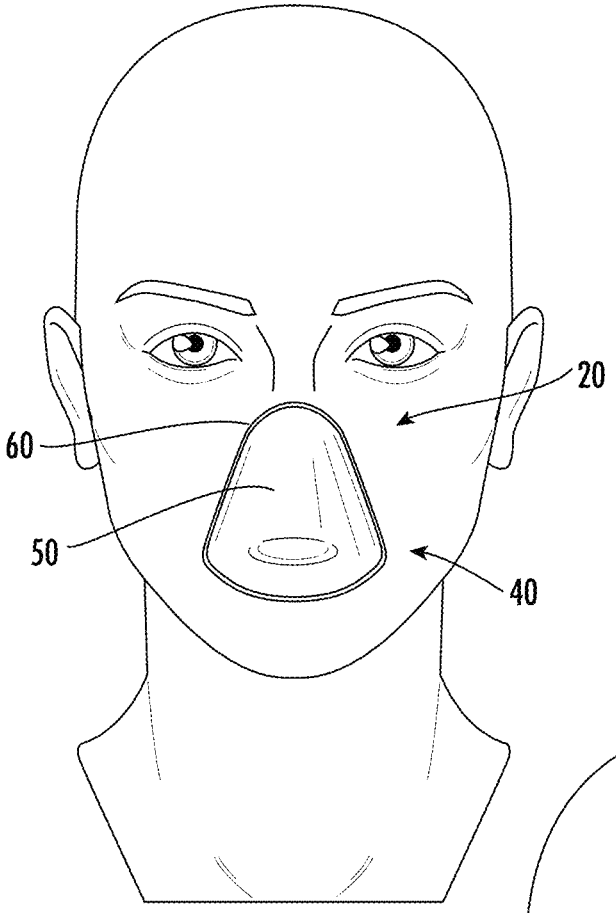
FIG. 5 is a front view of the face guard of FIG. 4 positioned on an athlete.
Figure 6:
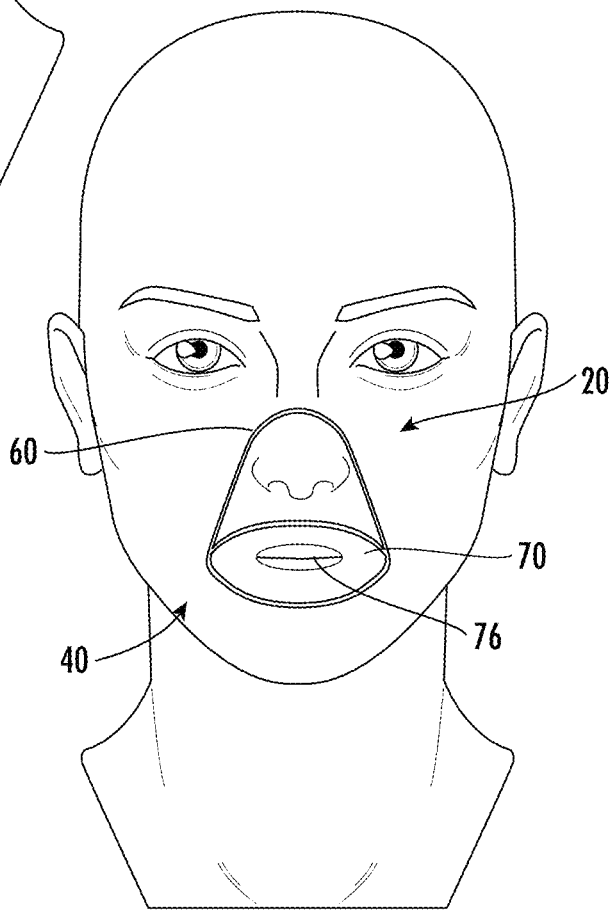
FIG. 6 is a front view of the face guard and athlete of FIG. 5 with the shield body shown in transparency to expose an airway.

With reference now to FIGS. 4-6 an alternative embodiment of the face guard 20 is shown. The embodiment of FIGS. 4-6 is similar to that of FIGS. 1-3. However, in the embodiment of FIGS. 4-6 the base portion 70 of the face mask 40 specifically includes an air passage 76 that extends completely through the base portion 70. The air passage 76 leads into an air passage in the connected mouthpiece 30, thus allowing the athlete to breathe through the air passage 76 when the faceguard 20 is worn. Although the mouth piece 30 is not shown in any of FIGS. 4-6, it will be recognized that the mouthpiece is directly behind the base portion 70 of the frame 60 in these figures. The mouthpiece 30 in this embodiment is similar to the dual arch mouthpiece 30 shown in FIG. 11, including an air passage 36 configured to align with an air passage 76 in the base 70 of the frame 60 of the face mask 40.

With continued reference to FIG. 4, in this embodiment of the face guard 20, the shield body 50 is configured to cover and/or abut the entire rim 62 of the frame 60, including covering the base portion 70 of the frame and the associated air passage 76. Because the body 50 covers the air passage 76, the transfer fluids and pathogens that would otherwise move through the air passage are abated. At the same time, the body 50 also covers the nose of the wearer and abates the transfer of fluids and pathogens through the nose.

As also shown in FIG. 4, a gasket 80 is provided that covers the perimeter of the shield body 50. The gasket is comprised of a relatively rigid and durable thermoplastic material, such as polyurethane or polyvinylchloride. Accordingly, the gasket provides durability and protection for the face mask 40. The gasket 80 may be connected to the shield body 50 and the frame 60 in any of various ways. For example, the gasket 80 may be a stitch down gasket that is coupled to the body 50 and the frame 60 using various stitches along the body. In another embodiment, the gasket 80 may be coupled to the body 50 and the frame 60 using adhesive, heat welding, or any of various other means for coupling the gasket to the body 50 and frame 60. The gasket 80 not only provides additional protection for the perimeter of the body 50 and frame 60, but also adds a clean look to the face mask by trimming out the perimeter edges of the body 50 and frame 60.

FIGS. 5 and 6 show the face guard 20 of FIG. 4 worn by an athlete. Advantageously, the face mask 40 completely covers the mouth and nose of the athlete when the mouthpiece 30 is inserted into their mouth. There is no need for straps or other means for mounting the face mask 40 on the athlete. As best shown in FIG. 6, the base portion 70 encircles and covers the lips of the athlete on the athlete's face. However, the air passage 76 provides a sufficient opening to allow for air to pass therethrough. Therefore, because of the air passage 76 in the base portion 70 of the frame 60, the athlete can easily breathe from both the nose and mouth during use. At the same time, the shield body 50 filters fluids and pathogens from being expelled-from or breathed-in by the athlete.

Three Part Shield Body

Figure 7:
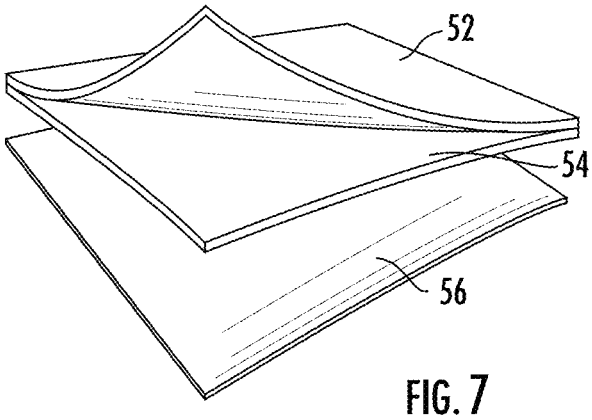
FIG. 7 is a perspective view of three layers of material used to form the shield body of the face guard of FIG. 4.

With reference now to FIG. 7, in at least one embodiment, the shield body 50 is advantageously comprised of a multi-layer construction that limits the transmission of moisture from the wearer's mouth and nose while also offering increased breathability relative to conventional face masks. In particular, as shown in FIG. 5, the body 50 includes an outer layer 52, a middle layer 54 and an inner layer 56.

The outer layer 52 of the body 50 provides an airgap spacer on an exterior side of the face mask 40. The outer layer 52 is comprised of a material that offers both structure for the face shield as well as a moisture barrier. The material of the outer layer 52 is generally a lightweight fabric, but still provides the face mask 40 with sufficient structure and body to keep the face mask largely separated from the mouth, nose, and surrounding skin of the wearer at the interior of the face mask 40. This separation provides for a mask that is significantly more comfortable for the wearer than conventional face masks and also allows for better airflow. The material of the outer layer also provides good moisture holding capacity for moisture vapor, while also inhibiting moisture from passing therethrough.

In at least one embodiment, the outer layer 52 is comprised of a circular knit spacer that is itself a three layer fabric made of 100% polyester. The circular knit spacer includes a first knit fabric layer provided parallel to a second knit fabric layer and separated by a space defined by another yarn. The polyester threads that form the first knit fabric layer provide for a generally smooth first surface that is parallel to a generally smooth second surface provided by the polyester threads of the second knit fabric layer (i.e., if the threads of the first knit fabric layer are considered to be in a first plane, the threads of the second knit fabric layer may be considered to be in a second plane that is parallel to the first plane). A number of crossing threads/yarns extend through the space and connect the first and second knit fabric layers (i.e., the crossing threads may be considered to extend perpendicular to the threads of the first knit fabric layer and the second knit fabric layer). The crossing threads are interknitted with the threads of the first and second knit fabric layers such that the first knit fabric layer is bound to the second knit fabric layer without the need for glues or other adhesives. The crossing threads provide the fabric with air pockets that add significant body to the fabric, resulting in a structure that has greater strength and maintains its form better than most fabrics. An exemplary construction of such a three layer fabric is disclosed in U.S. Pat. No. 4,785,558 to Shiomura, the entire contents of which are incorporated herein by reference. It will be recognized that in at least some embodiments the outer layer 52 is a stitched fabric layer, not a molded layer. This provides the mask with many of the advantages of fabrics, including increased comfort, flexibility, breathability, washability, and sustainability, and does not incorporate the downsides of molded structures, such as stiffness, limited airflow, and single use. In at least one embodiment, the yarns that form the first and second fabric layers are provided by a 100 denier 100% polyester yarn, and the crossing threads are provided by a 30 denier 100% polyester yarn.

In addition to the three layer fabric structure, the outer surface of the outer layer 52 is treated with a durable water repellent (DWR) finish. This DWR finish inhibits moisture from penetrating the outer layer 52 and moving into the mask. This provides the wearer with additional protection against moisture droplets that may be deposited on the face shield 30 from an outside source. In at least one embodiment, the DWR finish is provided by a C0 DWR material that prevents absorption from the outside while also making the finish more environmentally friendly.

With continued reference to FIG. 7, the middle layer 54 of the body 50 is sandwiched between the outer layer 52 and the inner layer 56. The middle layer 54 is comprised of a reticulated open cell foam. In at least one embodiment, the foam is 100% polyurethane. The open cell structure of the foam facilitates air-flow. At the same time, the structure of the foam has a high moisture holding capacity. Moisture droplets that enter the foam tend to remain in the foam until they are is flushed out; moisture does not wick into or out of the foam. The middle layer 54 is about ⅛ inch (3.17 mm) in thickness, and typically between 1/16 and ¼ inch (1.58 mm-6.35 mm). Accordingly, the middle layer is sufficiently thick to retain moisture, but not so thick that it is overly insulative and limits breathability.

The inner layer 56 is comprised of a relatively soft and flexible stretch fabric material configured for comfort when placed against the skin of the wearer, such as Iso-Chill Heat Gear® fabric sold by Under Armour, Inc. The material is further configured to wick moisture and cool the skin. Because the inner layer 56 faces the wearer, the inner layer 56 wicks moisture from the mouth and nose of the wearer into the middle layer 54, where the moisture is retained until it is flushed from the mask during washing. As a result, the inner layer 56 tends to remain relatively dry and does not become saturated with moisture droplets during use. In at least one embodiment, the inner layer is comprised of a knit warp fabric having a tricot construction and comprising 77% Polyamide, 23% Spandex. The fabric not only wicks, but is also configured to provide a cooling effect, drawing both moisture and heat away from the skin of the wearer.

In at least one embodiment, the fabric providing the inner layer 56 and/or the outer layer 52 is treated with an antiviral/antimicrobial compound designed to kill harmful viruses and/or other microbes that may be dispelled from the mouth and nose of the wearer. For example, the inner layer 56 may be treated with an antiviral chemical, such as PROTX2 AV, produced by Intelligent Fabric Technologies of North America. In tests PROTX2 AV has destroyed 99.9% of COVID-19 within 10 minutes, with residual killing power for 24 hours. In some embodiments, the antimicrobial compound may be mechanical and/or chemical in nature, such a crystalline structure that may be bonded to the surface, or a chemical treatment applied to the surface, as will be recognized by those of ordinary skill in the art. In at least some embodiments, the antimicrobial compound may be conveniently applied during the textile finishing process without requiring additional machinery or steps.

In at least some embodiments, the inner layer 56, middle layer 54, and outer layer 52 of the face shield body 50 are all tethered together at various locations with stitching extending through each of the layers. This stitching also assists in properly shaping the mask when in use in order to provide a structure that spaces the mask away from the face, and particularly the nostrils and mouth of the wearer. It this embodiment, there is no fastening or other connection between the layers 52, 54, 56 of the body other than the stitching. Accordingly, the layers of the body can somewhat shift and/or slide relative to one another at locations removed from the stitching. No glues or other adhesives that might limit breathability/air flow are included on the face mask 40.

An example of a face shield with a three-layer construction including an inner layer 56, middle layer 54, and outer layer 52, such as that described above, is disclosed in U.S. patent application Ser. No. 17/087,866, entitled "Breathable Face Mask", and filed on Nov. 3, 2020, the entire contents of which are incorporated herein by reference.

Face Mask with Floating Supports

Figure 8:
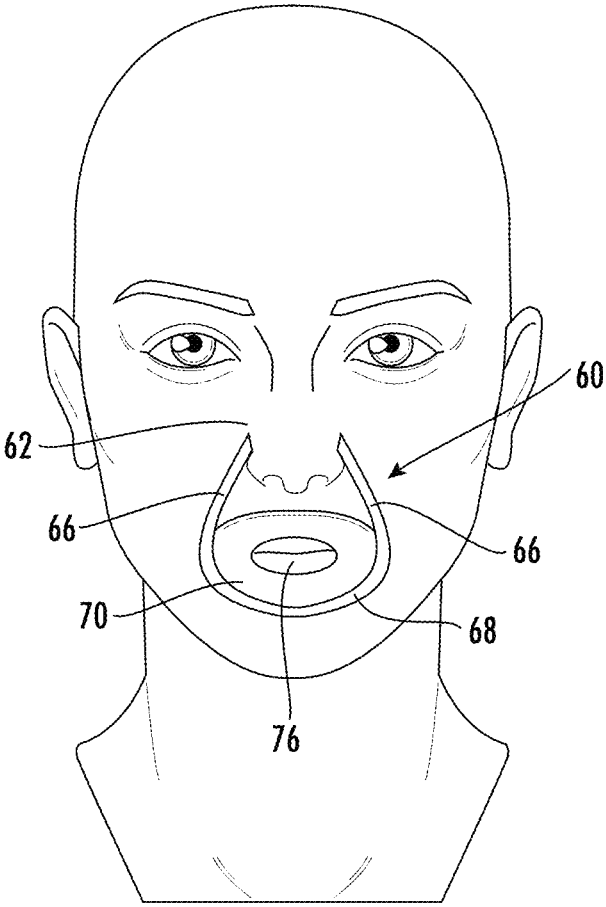
FIG. 8 is a front view of an alternative embodiment of the face guard of FIG. 4 positioned on an athlete with the shield portion removed to expose floating nose supports on a frame.
Figure 9:
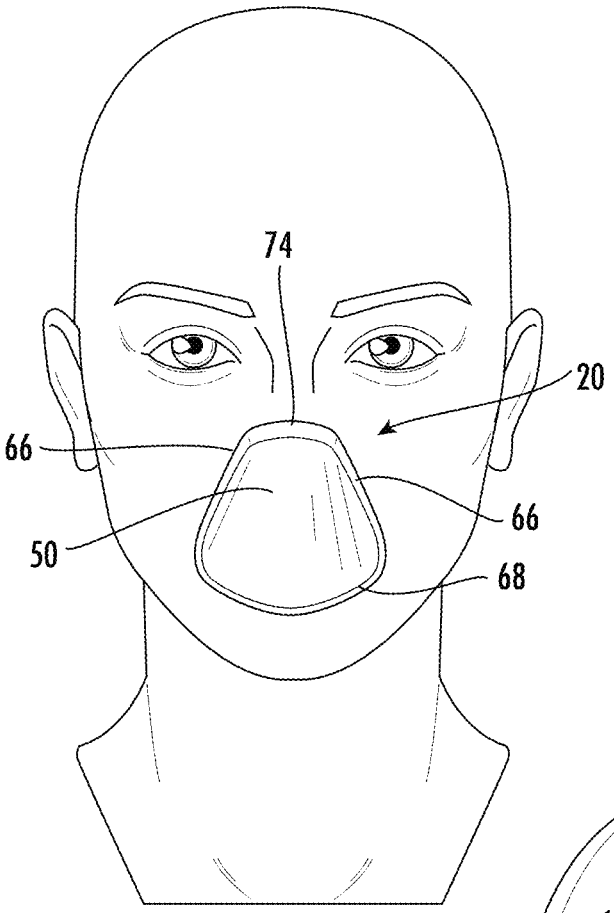
FIG. 9 is a front view of the face guard of FIG. 8 including the shield portion positioned on an athlete.
Figure 10:
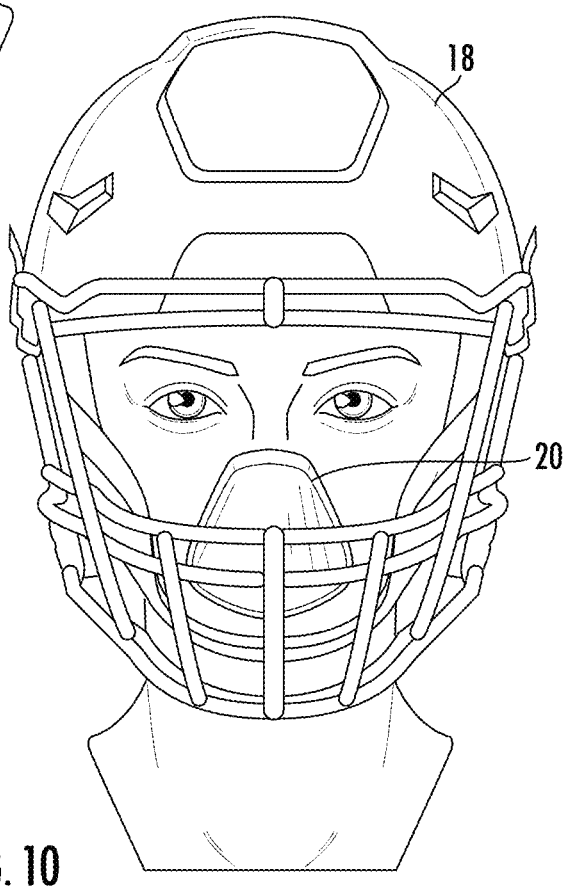
FIG. 10 is a front view of the athlete and face guard of FIG. 9 with the athlete wearing a helmet.

With particular reference now to FIGS. 8-10, an alternative embodiment of the face guard 20 is shown. The embodiment of FIGS. 8-10 is similar to that of FIGS. 4-6. However, in the embodiment of FIGS. 4-6 the upper portion 64 of the rim 62 is absent, resulting in two truncated side portions 66. These side portions 66 result in two cantilevers that extend upwardly and inwardly from opposite sides of base portion 70 and act as floating supports for the body 50 of the frame 60. Instead of the more rigid upper portion 64 a softer, malleable nose portion 74 is provided that extends between two the truncated ends on the side portions 66 of the frame 60, thus acting as a bridge between the two cantilevers on opposite sides of the base portion 70.

In at least one embodiment, the nose portion 74 is comprised of one or more layers of a relatively soft and flexible stretch fabric material configured for comfort when placed against the skin of the wearer, such as Iso-Chill Heat Gear® fabric sold by Under Armour, Inc. The flexible nature of the fabric used for the nose portion 74 allows the truncated side portions to float and more closely engage the contours along the side of the athlete's face. Additionally, the soft nature of the fabric provides significant additional comfort to the athlete when wearing the mask because no relatively rigid or hard materials contact the unpadded cartilage area of the nose.

In at least one embodiment, the malleable nose portion 74 also includes a nose bride encapsulated within the fabric that forms the nose portion 74. The nose bridge may be provided by a flexible metal membrane (such as aluminum) arranged within a plastic carrier. The carrier is stitched to the nose portion 74 in order to hold the nose bridge in place. The nose bridge is generally bendable and exhibits little resilience. Accordingly, the structure of the nose bridge is such that it may be easily conformed/bent to match the contours of the wearer's nose. Once the wearer bends the nose bridge, the nose bridge maintains its shape and helps maintain the engagement of the face guard 20 against the face of the wearer. While the nose bridge has been described herein as being comprised of a flexible metal membrane and carrier, it will be recognized that other configurations of the nose bridge are possible. For example, in at least one embodiment, the nose bridge is comprised of a tape member such as the BEMIS™ ST104 Seam Sealing Tape. In at least one embodiment, the nose bridge is comprised of a flexible silicone material that easily forms to the unique shape of the wearer's face and gradually cures over time, thus resulting in a mask that is eventually customized for a single user.

Mouthpiece Coupling to Face Mask

With particular reference now to FIG. 11, an exemplary connection between the mouthpiece 30 and the frame 60 of the face mask 40 is shown. The mouthpiece 30 is a dual arch mouthpiece that includes an upper tooth-receiving channel 32 and a lower tooth-receiving channel 34. An air passage 36 is included on the front of the mouthpiece between the upper and lower-tooth receiving channels 32, 34. The air passage 36 is of sufficient size to allow the athlete to easily breathe from the mouth with the mouthpiece positioned therein.

The base portion 70 of the frame 60 includes a central insert 86 that is designed and dimensioned to be received within the air passage 36 of the mouthpiece. The base portion 70 also includes an air passage 76 that extends completely through the base portion 70 at the central insert 86. The air passage 76 is also of sufficient size to allow the athlete to easily breathe from the mouth with the frame 60 inserted in the mouthpiece 30. When the mouthpiece is worn by the athlete, the base portion is positioned on the exterior of the face and cover the athlete's lips. While not shown in FIG. 11, a shield body 50, similar to that shown in the embodiments of FIGS. 1-10 is retained on the frame 60. As explained above, the shield body effectively abates the transmission of fluids and pathogens that may be transferred from and to the user during a sporting event.

Advantageously, in the embodiment of FIG. 11, the mouthpiece 30 and frame 60 may be either permanently coupled together or releasably coupled together. When permanently coupled together, the central insert 86 may be formed within the air passage 36 at the time of manufacture, such as by molding the components together as one piece. The components 30 and 60 may also be manufactured as two different pieces and subsequently coupled together using heat, adhesives, or any other suitable means for permanently coupling the components together. Alternatively, when configured for a releasable coupling, the components 30 and 60 are manufactured as separate parts and no permanent coupling is made. In such embodiment, a friction-fit, clip, shoulder abutment, or other type of coupling may be used to temporarily secure the face mask 40 to the mouthpiece 30.

When the athlete wishes to add the face mask 40 to the mouthpiece 30, the central insert 86 of the frame 60 is simply inserted into the air passage 36 of the mouthpiece 30 such that the two pieces are secured together (e.g., with a friction-fit, or any of various other means for non-permanent coupling the components). The fit is sufficiently tight such that the two components 30 and 60 are not releasable without significant pulling of the two components in opposite directions. In this manner, the mouthpiece 30 and face mask 40 may be repeatedly coupled and uncoupled and used in different configurations (i.e., the mouthpiece 30 with or without the face mask 40). At the same time, the central insert 86 serves as an extension to distance the base portion 70 of the face mask 40 from the front wall 38 of the mouthpiece 30 such that the wearer's lips may be comfortably positioned between the mouth piece 30 and the face mask 40 (i.e., forward of the front wall 38 of the mouthpiece 30 and rearward of the base portion 70 of the face mask 40). Accordingly, the central insert 86 will be recognized as one embodiment of an "extension" from the front of the mouthpiece 30.

While the central insert 86 is shown in FIG. 11 as being releasable from the mouthpiece 30, it will be recognized that in other embodiments noted herein, the central insert 86 may instead be provided as a mounting member that is integrally formed with and non-removable from the mouthpiece 30. In such embodiments, the mounting member 86 permanently connects the face mask 40 to the mouthpiece 30 in a spaced relation. In particular, the mounting member serves to extend between the rear surface of the base portion 70 of the face mask 40 and the front surface of the mouth guard 30, thus arranging the mouth guard 30 and the face mask 40 in a predetermined spaced relation (e.g., between 1*cm* and 3*cm* apart).

The foregoing detailed description of one or more embodiments of a face guard has been presented herein by way of example only and not limitation. It will be recognized that there are advantages to certain individual features and functions described herein that may be obtained without incorporating other features and functions described herein. Moreover, it will be recognized that various alternatives, modifications, variations, or improvements of the above-disclosed embodiments and other features and functions, or alternatives thereof, may be desirably combined into many other different embodiments, systems or applications. Presently unforeseen or unanticipated alternatives, modifications, variations, or improvements therein may be subsequently made by those skilled in the art which are also intended to be encompassed by any appended claims. Therefore, the spirit and scope of any appended claims should not be limited to the description of the embodiments contained herein.

What is claimed is:

1. A face guard for a human user having a face with a mouth and nose, the face guard comprising:

a mouthpiece configured for retention in the mouth of the human user; and an air permeable face mask coupled to the mouthpiece, the face mask including a base portion and at least one fabric layer, the base portion defining an interior side and an exterior side, the mouthpiece coupled to the face mask at the interior side of the base portion, and the at least one fabric layer configured to cover the mouth and nose of the human user, wherein an air passage extends through the mouthpiece and the base portion, and wherein the fabric layer is continuous and uninterrupted extending over the air passage at the base portion.

2. The face guard of claim 1 wherein the face guard includes a frame and a shield body that extends across the frame, wherein the at least one fabric layer is part of the shield body.

3. The face guard of claim 2 wherein the perimeter rim includes two cantilever side portions.

4. The face guard of claim 3 further comprising a malleable nose portion that extends between truncated ends of the cantilever side portions.

5. The face guard of claim 4 wherein the malleable nose portion is comprised of a nose bridge encapsulated within a fabric material.

6. The face guard of claim 2 wherein the frame defines a perimeter rim, and wherein the shield body is coupled to the perimeter rim.

7. The face guard of claim 6 further comprising a gasket that covers the shield body along the perimeter rim.

8. The face guard of claim 1 wherein the mouthpiece includes at least one of an upper tooth receiving channel and a lower tooth receiving channel.

9. The face guard of claim 1 wherein the base portion of the face mask and the mouthpiece are comprised of a same material.

10. The face guard of claim 1 wherein the face mask further comprises a perimeter rim connected to the base portion, and wherein the mouthpiece and the face mask are of a unitary monolithic construction.

11. The face guard of claim 1 wherein the face mask is removably coupled to the mouthpiece.

12. A face guard for a human user having a mouth, the face guard comprising: a mouthpiece configured for retention in an interior of the mouth of the human user; and 2055-0286 a face mask coupled to the mouthpiece, the face mask including a multi-layer shield body configured to cover an exterior of the mouth of the human user, wherein the multi-layer shield body defines an interior side and an exterior side and comprises a foam layer positioned between an inner fabric layer and an outer fabric layer, and wherein the exterior side of the multi-layer shield body is continuous and uninterrupted.

13. The face guard of claim 12 wherein the foam layer is comprised of an open cell foam.

14. The face guard of claim 12 wherein the inner fabric layer is comprised of a stretch fabric material.

15. The face guard of claim 12 wherein the outer fabric layer is comprised of a circular knit spacer.

16. A face guard comprising:

a mouth piece;

an extension from a front of the mouthpiece;

an air passage extending through the mouthpiece and the extension; and an air permeable face mask connected to the extension, the air permeable face mask including a frame defining a left side and a right side with at least one fabric layer retained by the frame, the at least one fabric layer defining an interior side and an exterior side, the at least one fabric layer extending from the left side to the right side of the frame with the exterior side of the at least one fabric layer continuous and uninterrupted across the frame.

17. The face guard of claim 16 wherein the at least one fabric layer and has a width sufficient to cover at least a width of a human mouth when the mouthpiece is inserted into the human mouth.

* * * * *